US010508884B1

(12) United States Patent
Chen

(10) Patent No.: US 10,508,884 B1
(45) Date of Patent: Dec. 17, 2019

(54) TRIGGER ASSEMBLY OF A CROSSBOW

(71) Applicant: Combis Sport Enterprise Co., Ltd., Taichung (TW)

(72) Inventor: Chu-Wei Chen, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 16/164,866

(22) Filed: Oct. 19, 2018

(51) Int. Cl.
*F41B 5/12* (2006.01)
*F41A 19/10* (2006.01)
*F41A 17/46* (2006.01)
*F41B 5/14* (2006.01)

(52) U.S. Cl.
CPC ..... *F41B 5/12* (2013.01); *F41A 17/46* (2013.01); *F41A 19/10* (2013.01); *F41B 5/1469* (2013.01)

(58) Field of Classification Search
CPC ..... F41B 5/12; F41B 5/123; F41B 5/1469; F41A 17/46; F41A 19/10
USPC ..... 124/25
See application file for complete search history.

(56) References Cited

U.S. PATENT DOCUMENTS 5,598,829 A * 2/1997 Bednar ..... F41A 17/28 124/25
5,649,520 A * 7/1997 Bednar ..... F41B 5/12 124/25
5,884,614 A * 3/1999 Darlington ..... F41B 5/12 124/25
6,736,123 B1 * 5/2004 Summers ..... F41A 17/46 124/25
6,802,304 B1 * 10/2004 Chang ..... F41B 5/1469 124/25
7,588,022 B2 * 9/2009 Chang ..... F41B 5/123 124/25
7,770,567 B1 * 8/2010 Yehle ..... F41A 17/46 124/25
8,091,540 B2 * 1/2012 Matasic ..... F41B 5/12 124/25
8,651,094 B2 * 2/2014 Matasic ..... F41B 5/12 124/23.1
8,770,178 B2 * 7/2014 Kempf ..... F41A 19/10 124/25
8,899,218 B2 * 12/2014 Kempf ..... F41B 5/1469 124/35.1
9,004,053 B1 * 4/2015 Anderson ..... F41B 5/1469 124/31
9,140,516 B1 * 9/2015 Hyde ..... F41B 5/12
9,255,754 B1 * 2/2016 Kempf ..... F41B 5/12
9,255,755 B1 * 2/2016 Barnett ..... F41B 5/12
9,404,705 B2 * 8/2016 Kennedy ..... F41B 5/1469
9,435,605 B2 * 9/2016 McPherson ..... F41A 17/46
(Continued)

*Primary Examiner* — Alexander R Niconovich
(74) *Attorney, Agent, or Firm* — Alan D. Kamrath; Karin L. Williams PC; Mayer & Williams PC

(57) ABSTRACT

A crossbow includes a stock, a bow connected to the stock, a string connected to the bow, a string loader for loading the string, and a trigger and safety apparatus for controlling the string. The trigger and safety apparatus includes a trigger unit, a trigger safety unit and a string safety unit. Due to the use of the string safety unit, loading and locking of the string are synchronously executed, and loading of the arrow and disabling of the string safety unit are synchronously executed. The trigger safety unit is movable between a locking position and an unlocking position. In the locking position, the trigger safety unit unlocks the trigger unit.

12 Claims, 14 Drawing Sheets

(56) References Cited

U.S. PATENT DOCUMENTS

| | | | | |
|---|---|---|---|---|
| 9,506,715 | B2 * | 11/2016 | Hughes | F41A 19/10 |
| 9,557,134 | B1 * | 1/2017 | Yehle | F41B 5/12 |
| 9,726,454 | B2 * | 8/2017 | McPherson | F41B 5/123 |
| 9,851,170 | B1 * | 12/2017 | Liu | F41B 5/12 |
| 9,909,832 | B2 * | 3/2018 | Darlington | F41A 17/56 |
| 9,958,232 | B1 * | 5/2018 | Egerdee | F41B 5/1403 |
| 10,012,468 | B1 * | 7/2018 | Kempf | F41B 5/1469 |
| 10,066,894 | B1 * | 9/2018 | Kempf | F41B 5/12 |
| 10,215,520 | B1 * | 2/2019 | Liu | F41B 5/12 |
| 10,215,522 | B1 * | 2/2019 | Kempf | F41B 5/12 |
| 10,281,230 | B2 * | 5/2019 | Khoshnood | F41B 5/10 |
| 2012/0048252 | A1 * | 3/2012 | Chu | F41B 5/12 124/25 |

* cited by examiner

TRIGGER ASSEMBLY OF A CROSSBOW

BACKGROUND OF INVENTION

1. Field of Invention

The present invention relates to a crossbow and, more particularly, to a crossbow with a trigger and safety apparatus that is automatically locked during the loading of a string and unlocked after the setting of an arrow.

2. Related Prior Art

A typical crossbow includes a stock, a bow, a string, a loading lever and a trigger. The bow is transversely connected to the stock. Two ends of the string are connected to two limbs of the bow. The loading lever is pivotally connected to the stock and operated to load the string and an arrow. The trigger is pivotally connected to the stock and operated to release the string from the loading lever.

During the loading of the string and the arrow, the string might be released and the arrow projected by accident. The accidentally projected arrow could hurt a user or other persons. Most conventional crossbows are not equipped with any safety devices to avoid such accidental projection.

Some conventional crossbows are equipped with safety devices. A conventional safety device can only be actuated to lock the trigger after the string is loaded. However, the user could forget to actuate the safety device because the safety device is not automatically actuated. Hence, the safety of the user and other persons are not ensured.

Moreover, the safety device can only be used to lock the trigger and could easily be disabled to release the trigger. Hence, the safety device is not reliable.

The present invention is therefore intended to obviate or at least alleviate the problems encountered in prior art.

SUMMARY OF INVENTION

It is the primary objective of the present invention to provide a crossbow with a reliable trigger and safety apparatus.

To achieve the foregoing objective, the trigger and safety apparatus includes a box, a string hook, a trigger unit, a string safety unit and a trigger safety unit. The box is inserted in a stock of the crossbow, and includes an aperture, a passageway and two slots. The string hook includes a rear portion, a front portion, a middle portion connected to an internal portion of the box. Thus, the string hook is movable between a hooking position where the front portion of the string hook hooks a string of the crossbow and a releasing position where the front portion of the string hook releases the string. The string hook is moved to the locking position when the string is loaded. A spring is used for biasing the string hook to the releasing position. The trigger unit includes a trigger, a lever, a connector and a restraining element. The trigger is connected to the stock. The lever includes an upper portion inserted in the box and a lower portion extending from the box via the aperture. Another spring is used for biasing the lever. The connector connects the trigger to the lever. The restraining element is inserted in the box, and includes a front face and an upper end. The front face is in contact with the rear portion of the string hook as the string hook is in the releasing position. The upper end is in contact with the rear portion of the string hook as the string hook is in the hooking position. Another spring is used for biasing the restraining element so that the upper end of the restraining element abuts against the rear portion of the string hook to keep the string hook in the hooking position and that the restraining element prevents the lever from pivoting. The trigger safety unit includes a safety element that includes two sliding portions, an intermediate portion, a locking portion and two handles. The sliding portions are movably inserted in the box so that the safety element is movable between a locking position and an unlocking position. The intermediate portion interconnecting the sliding portions. The locking portion extends from the intermediate portion. The handles extend out of the box from the sliding portions through the slots. The string safety unit includes a stopper. The stopper is inserted in the box and includes an upper portion and a rear portion. Another spring is used for biasing the stopper so that the upper portion of the stopper is inserted in the passageway and that the rear portion of the stopper abuts against the lever. The locking portion hinders movement of the lever when the safety element is in the locking position, wherein the locking portion allows the lever to move when the safety element is the unlocking position.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
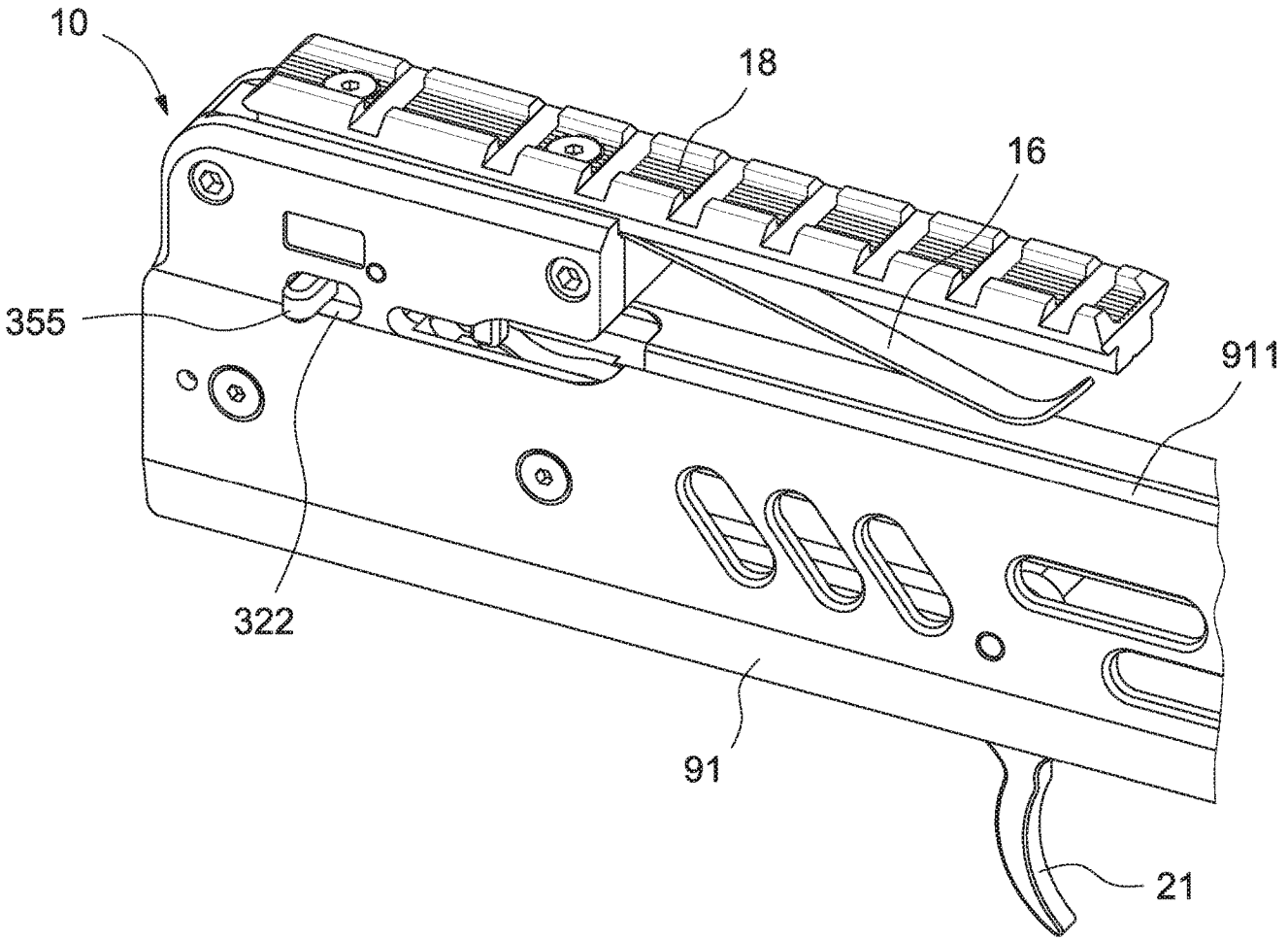
FIG. 1 is a partial perspective view of a crossbow according to the preferred embodiment of the present invention.

Referring to FIGS. 1 to 9, a crossbow includes a stock 91, a string 92 and a trigger and safety apparatus according to the preferred embodiment of the present invention. The crossbow further includes a bow (not shown) and a string loader (not shown). The stock 91 includes a groove 911 in an upper face. The bow is transversely supported on the upper face of the stock 91. Two ends of the string 92 are connected to two limbs of the bow. The string loader is movably connected to the stock 91 and operated to load the string 92. The trigger and safety apparatus is connected to the stock 91 and operated to release the string 92 to project an arrow 93. The trigger and safety apparatus includes a box 10, a trigger unit, a trigger safety unit and a string safety unit. The safety units are used to ensure safety in operation of the crossbow.

Referring to FIGS. 1, 2 and 5 to 7, the box 10 is inserted in and connected to the stock 91. The box 10 includes a shell 12 and a cover 14. The shell 12 is connected to the cover 14 in use.

The shell 12 includes a space 121, a groove 122, a slot 123, an aperture 124, four cavities 1251, 1252, 1253 and 1254, three contact faces 1261, 1262 and four rods 1271, 1272, 1273 and 1274, a recess 1281, and a groove 129. The shell 12 includes a substantially U-shaped rib 1212 extending around the space 121.

The cover 14 is shaped corresponding to the shell 12. The cover 14 is connected to the substantially U-shaped rib 1212 of the shell 12. The cover 14 includes a groove 142 corresponding to the groove 122, a slot 143 corresponding to the slot 123, and a recess 1481 corresponding to the recess 1281.

Figure 5:
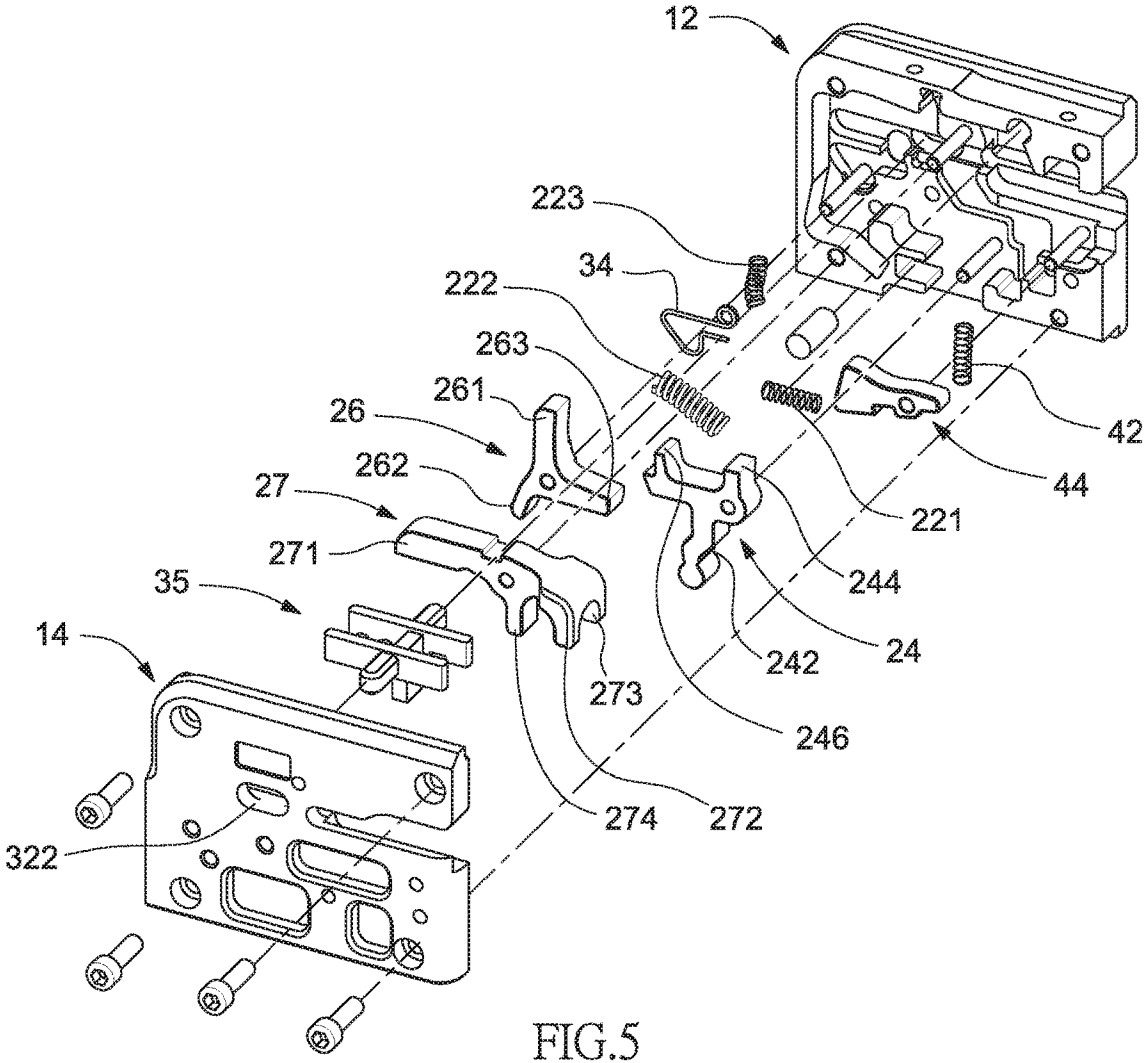
FIG. 5 is an exploded view of the trigger and safety apparatus shown in FIG. 3.
Figure 6:
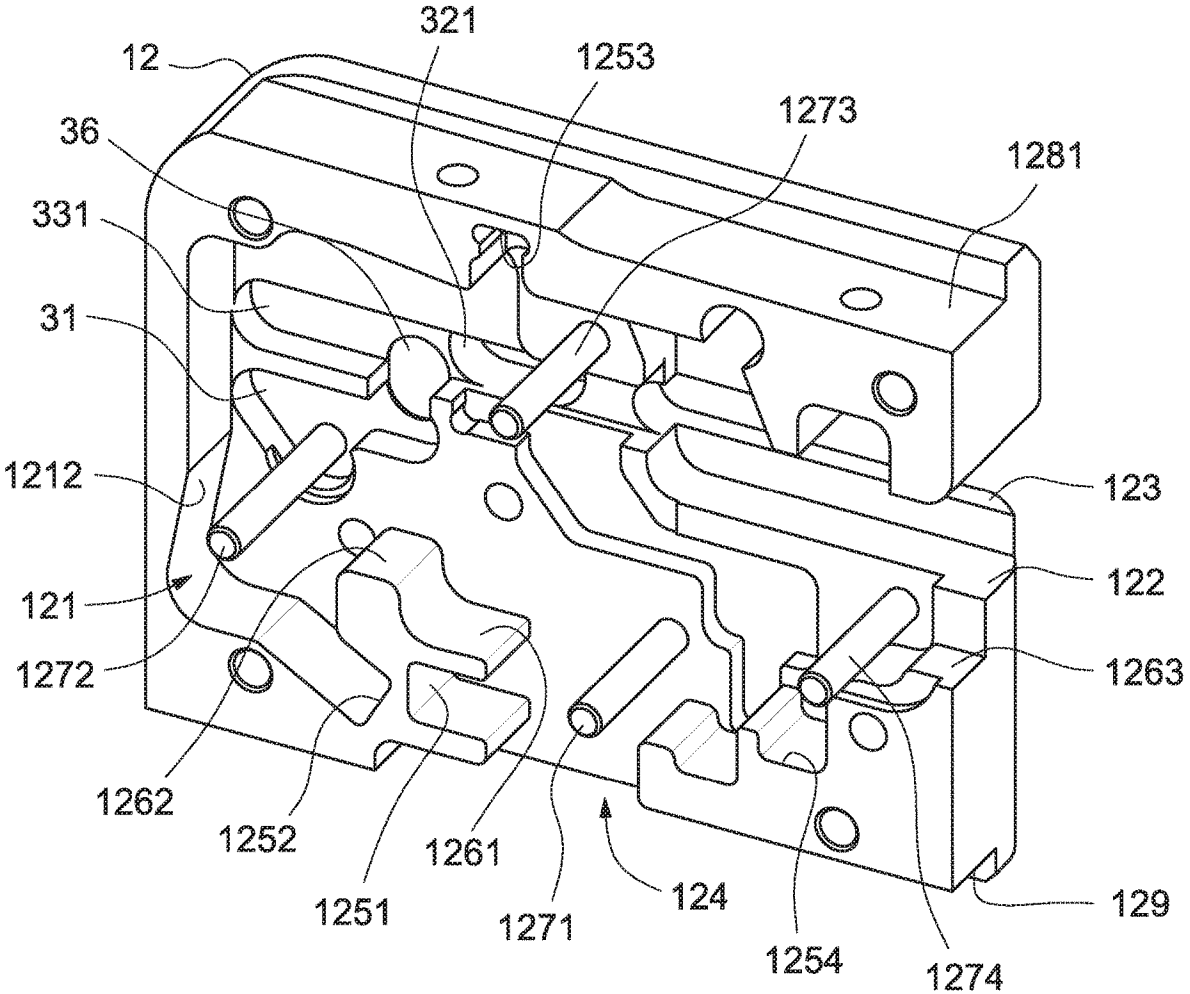
FIG. 6 is an enlarged view of a shell of the box of the trigger and safety apparatus shown in FIG. 5.
Figure 7:
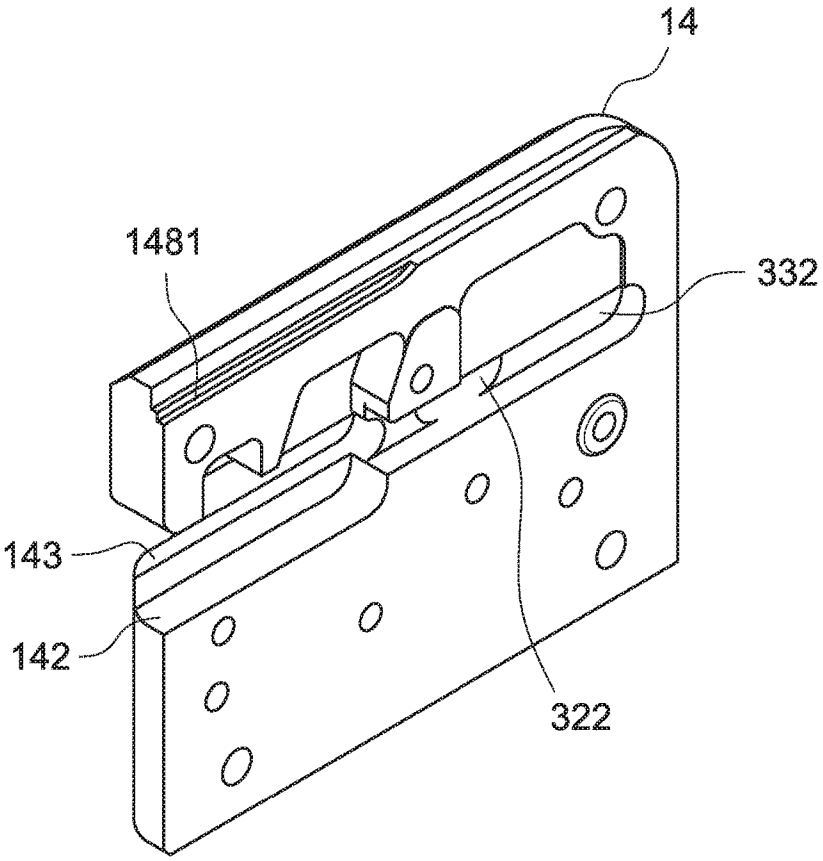
FIG. 7 is an enlarged view of the cover of the box of the trigger and safety apparatus shown in FIG. 5, with the cover pivoted for 90 degrees.

Referring to FIGS. 5 to 7, the grooves 122 and 142 are located on two opposite sides of the space 121 of the shell 12. Each of the grooves 122 and 142 includes an open front end in a front face of the box 10. The grooves 122 and 142 together provide a passage via which a nock of the arrow 93 is inserted into and projected from the box 10. To this end, the passage, which includes the grooves 122 and 142, is in communication with the groove 911 of the stock 91. The slots 123 and 143 are used to receive fletching of the arrow 93.

Referring to FIGS. 5 to 7, the slots 123 and 143 are located on two opposite sides of the space 121 of the shell 12. The slot 123 is made in a lateral face of the shell 12. The slot 143 is made in a lateral face of the cover 14. The slots 123 and 143 are in communication with the grooves 122 and 142.

Referring to FIG. 6, the aperture 124 is located in a lower face of the shell 12, in the substantially U-shaped rib 1212.

Referring to FIG. 6, the cavities 1251, 1252, 1253 and 1254 are made in proper locations in the substantially U-shaped rib 1212.

Referring to FIG. 6, the contact faces 1261, 1262 and 1263 are formed on proper portions of the substantially U-shaped rib 1212.

Referring to FIG. 6, the rods 1271, 1272, 1273 and 1274 are formed on proper portions of the substantially U-shaped rib 1212.

Referring to FIGS. 2 through 7, the recess 1281 is made in an upper face of the shell 12. The recess 1481 is made in an upper face of the cover 14. The recesses 1281 and 1481 together provide a groove in an upper face of the box 10 when the shell 12 is connected to the cover 14. The recesses 1281 and the 1481 can be omitted in another embodiment.

Referring to FIG. 6, the groove 129 is made in a lower face of the box 10. In specific, the groove 129 is made in a lower face of the shell 12 and/or the cover 14. The groove 129 can be omitted in another embodiment.

Figure 2:
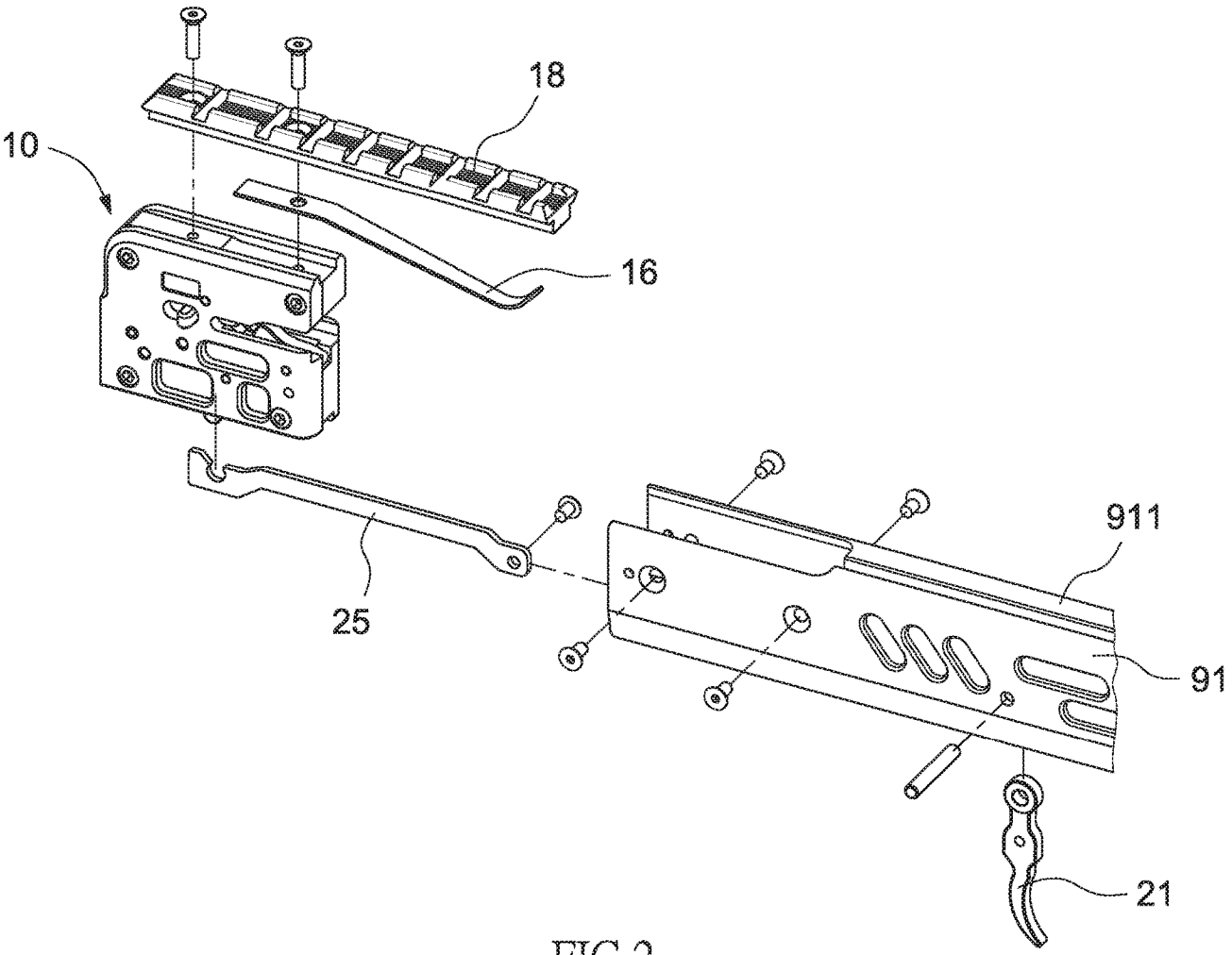
FIG. 2 is an exploded view of the crossbow shown in FIG. 1.
Figure 3:
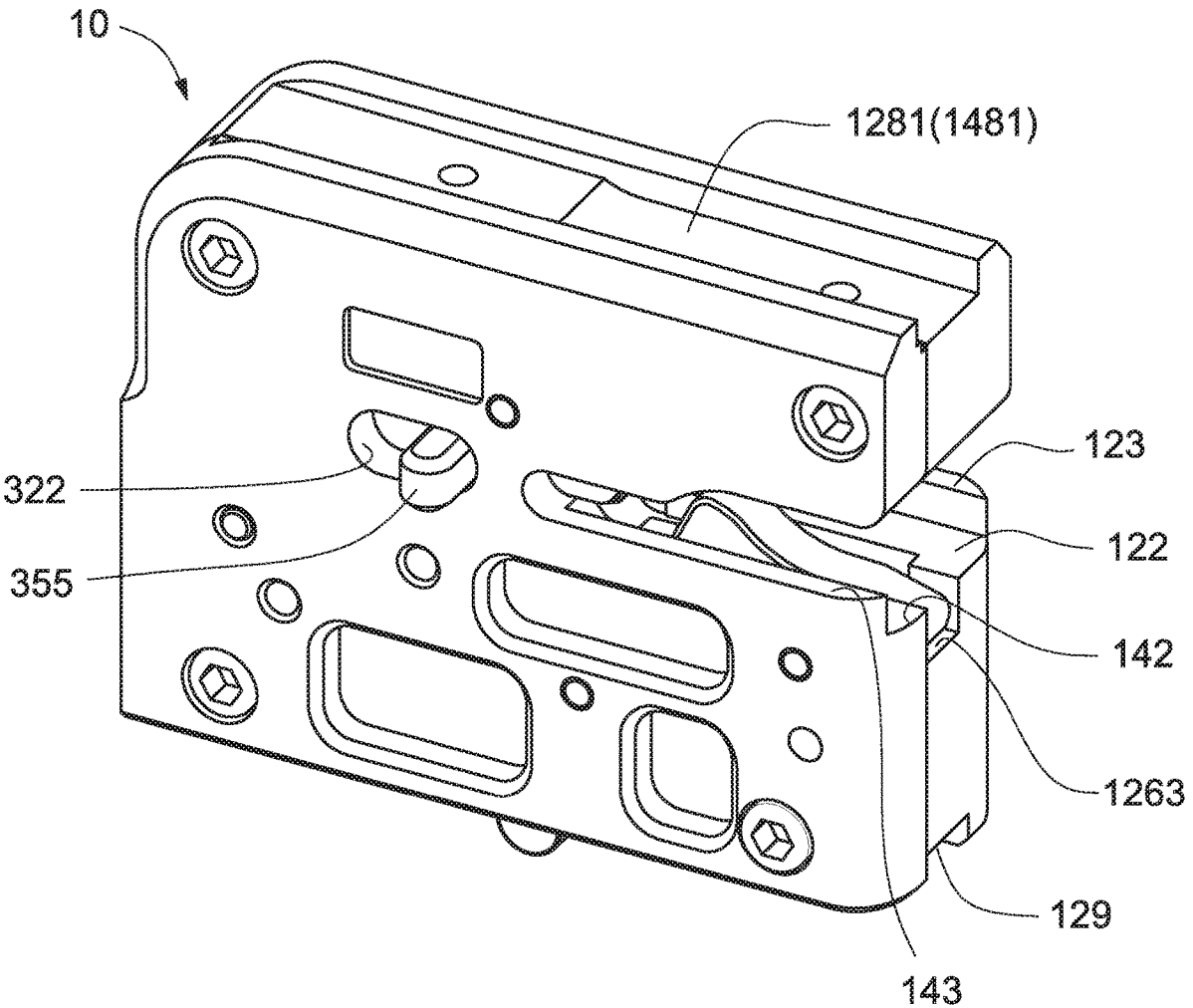
FIG. 3 is a perspective view of a trigger and safety apparatus of the crossbow shown in FIG. 2.

Referring to FIGS. 1 and 2, an arrow-pressing element 16 is connected to the upper face of the box 10. The arrow-pressing element 16 includes a rear portion inserted in the recesses 1281 and 1481 and a front portion located above the groove 911.

Referring to Referring to FIGS. 1 and 2, a Picatinny rail 18 is connected to the upper face of the box 10. The Picatinny rail 18 includes a rear portion inserted in the recesses 1281 and 1481 and a front portion located above the groove 911. The rear portion of the Picatinny rail 18 is located on the rear portion of the arrow-pressing element 16. The front portion of the Picatinny rail 18 is located above the front portion of the arrow-pressing element 16. The Picatinny rail 18 is used to support accessories such as a scope.

Referring to FIGS. 2 and 4 to 8, the trigger unit is inserted in the box 10 and the stock 91. The trigger unit includes a trigger 21, three springs 221, 222 and 223, a lever 24, a connector 25, a restraining element 26 and a string hook 27.

Referring to FIGS. 1 and 2, the trigger 21 includes an upper portion inserted in and pivotally connected to stock 91 and a lower portion located out of the stock 91.

Referring to FIGS. 1, 2 and 5 to 7, the springs 221, 222 and 223 are inserted in the cavities 1251, 1252 and 1253, respectively.

Figure 4:
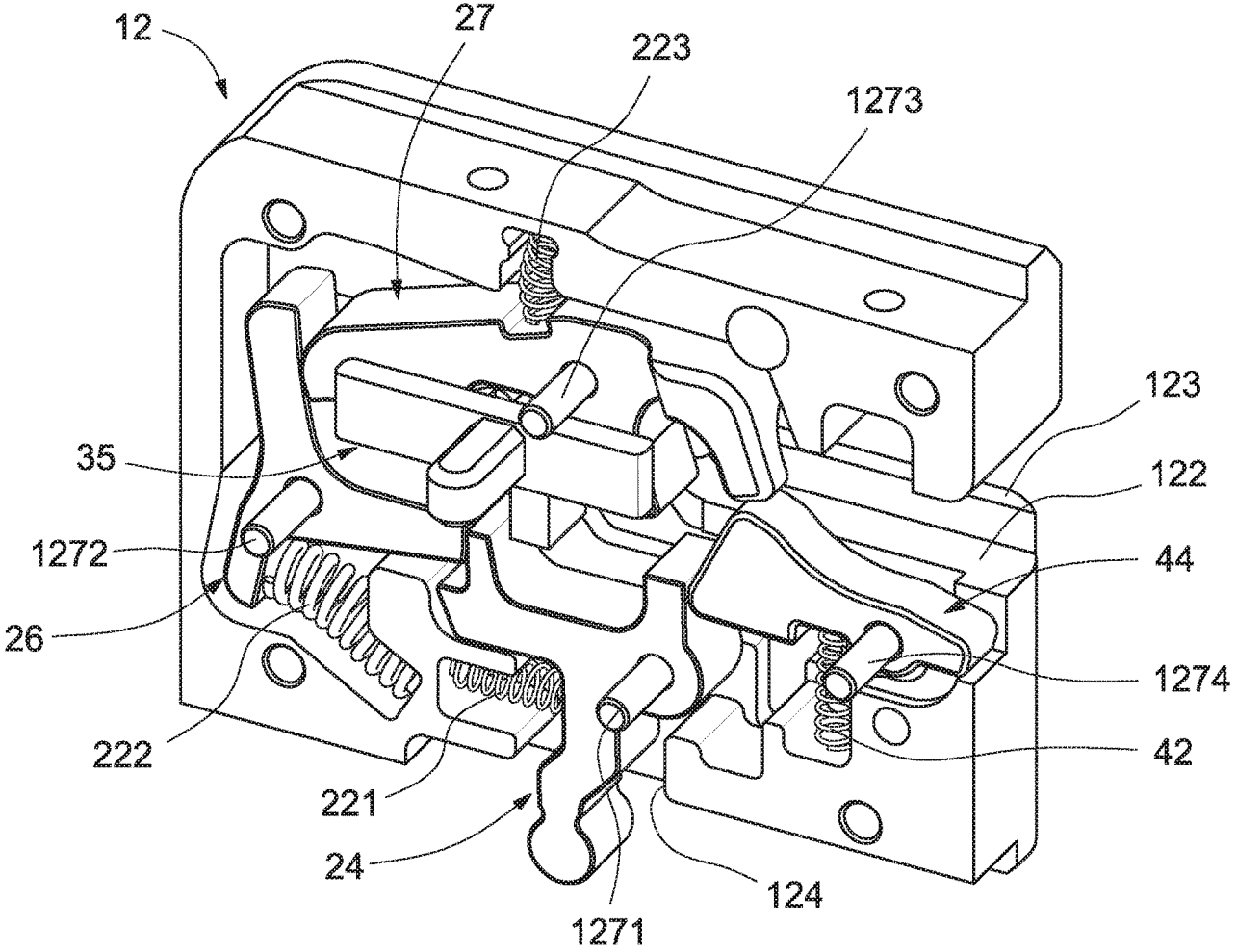
FIG. 4 is a perspective view of the trigger and safety apparatus shown in FIG. 3, with a cover of a box removed.

Referring to FIGS. 4 and 5, the lever 24 includes a T-shaped body 242 and two abutting portions 244 and 246. The T-shaped body 242 includes an upper portion that extends substantially horizontally and a lower portion that extends substantially vertically. The abutting portions 244 and 246 are formed on the upper portion of the T-shaped body 242. A front end of the upper portion of the T-shaped body 242 is connected to the rod 1271. The lower portion of the T-shaped body 242 extends out of the box 10 via the aperture 124, and is abutted against the spring 221 so that a rear end of the upper portion of the T-shaped body 242 is in contact with the of the contact face 1261.

Referring to FIG. 2, an end of the connector 25 is connected to trigger 21. Another end of the connector 25 is connected to the lower portion of the T-shaped body 242 of the lever 24, which is located out of the box 10.

Referring to FIGS. 4 to 6, the restraining element 26 is pivotally connected to the rod 1272. The restraining element 26 includes three branches 261, 262 and 263. The branch 261 substantially extends upward. The branch 262 substantially extends downward. The branch 263 substantially extends forward. The branch 262 is biased by the spring 222 so that the branch 263 is abutted against the contact face 1262 and/or the upper portion of the T-shaped body 242 of the lever 24.

Referring to FIGS. 4 to 6, the string hook 27 includes a bar 271, two claws 272, a gap 273 and a crank 274. A middle portion of the bar 271 is pivotally connected to the rod 1273. The claws 272 extend substantially downward from a front portion of the bar 271. The claws 272 are separated from each other by the gap 273. The gap 273 is located above the groove 911 of the stock 91. The crank 274 extends substantially downward from the middle portion of the bar 271. The crank 274 is located behind the gap 273. A rear portion of the bar 271 of the string hook 27 is biased by the spring 223 so that the front portion of the bar 271 of the string hook 27, from which the claws 272 extend, is biased toward an upper portion of the substantially U-shaped portion 1212. The rear portion of the bar 271 is abutted against the branch 261 of the restraining element 26.

Referring to FIGS. 3 to 8, the trigger safety unit includes an elastic latch 34 and a safety element 35. To contain the elastic latch 34, the shell 12 includes a cavity 31. To contain the safety element 35, the shell 12 includes a slot 321 and a groove 331, and the cover 14 includes a slot 322 and a groove 332. The groove 331 is in communication with the slot 321. The groove 332 is in communication with the slot 322. The shell 12 further includes a trouble-shooting aperture 36 to allow access to the trigger safety unit.

Referring to FIGS. 5 and 6, the elastic latch 34 is made by bending a metal rod. The elastic latch 34 is inserted in the cavity 31. The elastic latch 34 includes a loop (not numbered) formed at an end inserted in the grooves 331 and 332. The loop of the elastic latch 34 can be forced out of the grooves 331 and 332.

Figure 8:
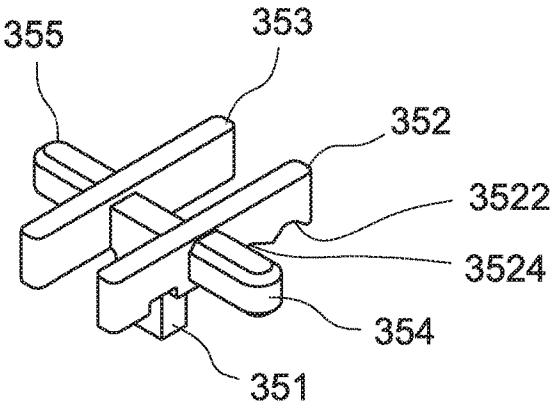
FIG. 8 is a perspective view of a safety element of the trigger unit shown in FIG. 5.

Referring to FIGS. 5, 6 and 8, the safety element 35 includes a locking portion 351, two sliding portions 352 and 353, two handles 354 and 355 and an intermediate portion (not numbered). The intermediate portion of the safety element 35 interconnects the sliding portions 352 and 353. There is a gap between the sliding portions of 352 and 353. At least the sliding portion 352 includes two positioning recesses 3522 and 3524 in a lower face. The locking portion 351 extends downward from the intermediate portion of the safety element 35. The handle 354 laterally extends from the sliding portion 352. The handle 355 laterally extends from the sliding portions 353.

The safety element 35 is inserted in the grooves 331 and 332 and the slots 321 and 322. The safety element 35 is movable between a locking position and an unlocking position by an external force or the string hook 2.

The sliding portions 352 and 353 are movably inserted in the grooves 331 and 332, respectively. The bar 271 and the crank 274 are movable in the gap between the sliding portions of 352 and 353 to allow the crank 274 to come into contact with the intermediate portion of the safety element 35. The positioning recess 3522 receives the loop of the elastic latch 34 as the safety element 35 is in the unlocking position. The positioning recess 3524 receives the loop of the elastic latch 34 as the safety element 35 is in the locking position.

The handle 354 extends out of the box 10 via the slot 321. The handle 355 extends out of the box 10 via the slot 322. The locking portion 351 is located above the abutting portion 246 of the lever 24 to prevent the lever 24 from pivoting when the safety element 35 is in the locking position. The locking portion 351 is located between the abutting portions 244 and 246 of the lever 24 not to interfere with movement of the lever 24 as the safety element 35 is in the unlocking position.

Referring to FIG. 6, the trouble-shooting aperture 36 is in communication with the groove 331 and the cavity 31. The trouble-shooting aperture 36 is on the way of the elastic latch 34 extending into the groove 331. Thus, a tool can be inserted into the shell 12 via the trouble-shooting aperture 36 to move the elastic latch 34 when the elastic latch 34 is jammed.

The string safety unit is inserted in the space 121. The string safety unit includes a spring 42 and a stopper 44.

Figure 9:
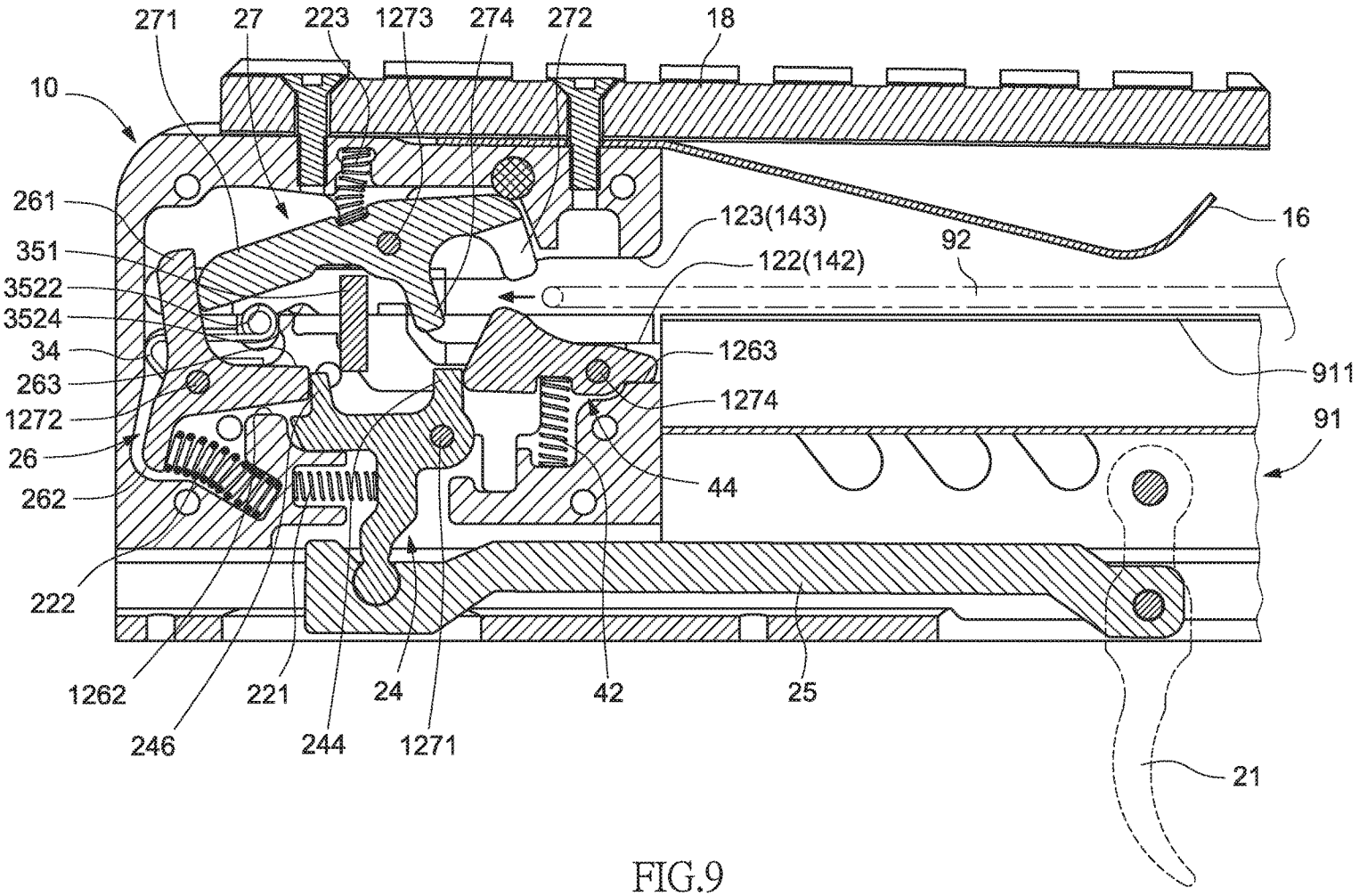
FIG. 9 is a cross-sectional view of the crossbow shown in FIG. 1.
Figure 10:
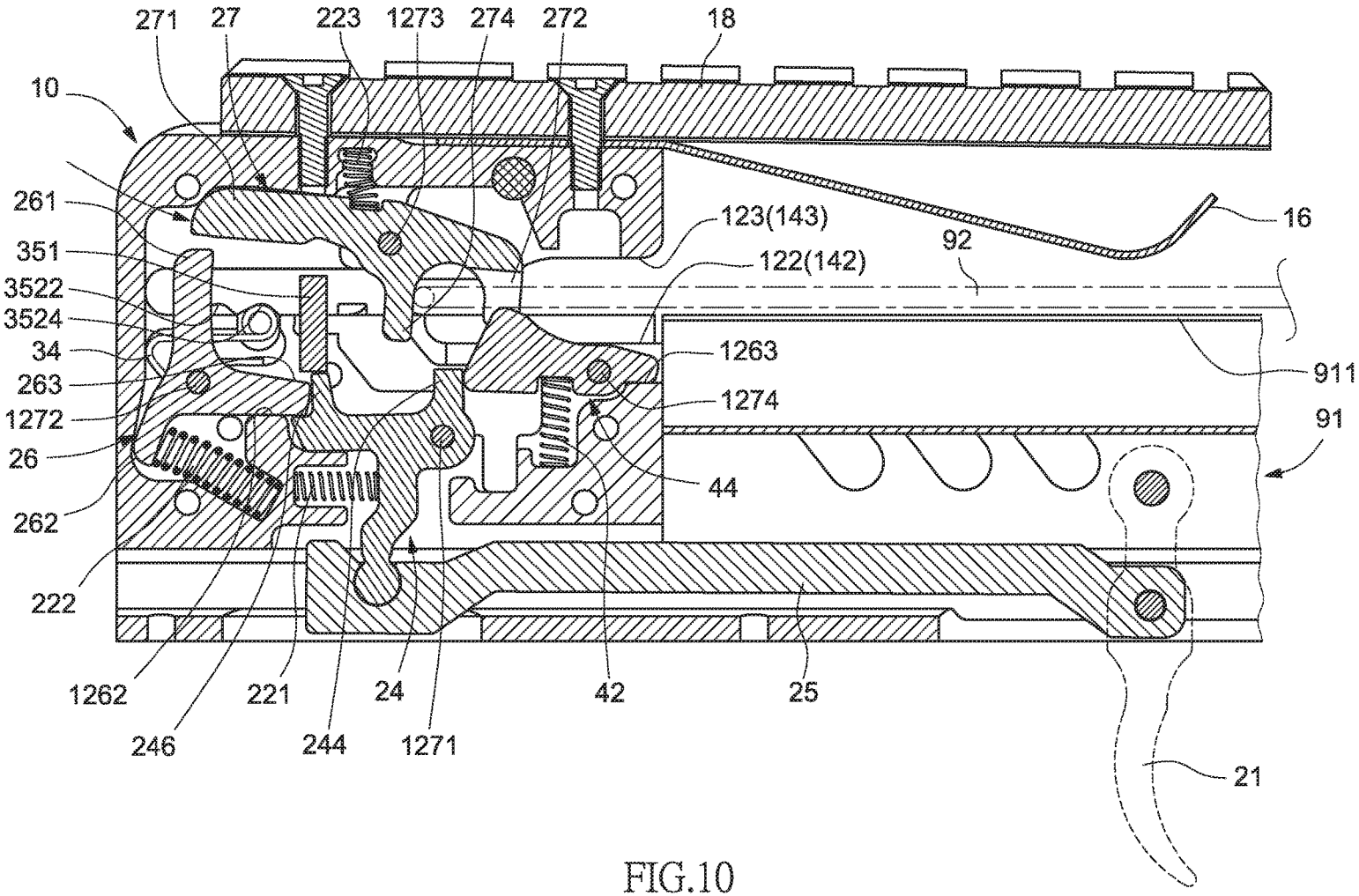
FIG. 10 is a cross-sectional view of the crossbow in another position than shown in FIG. 9.
Figure 12:
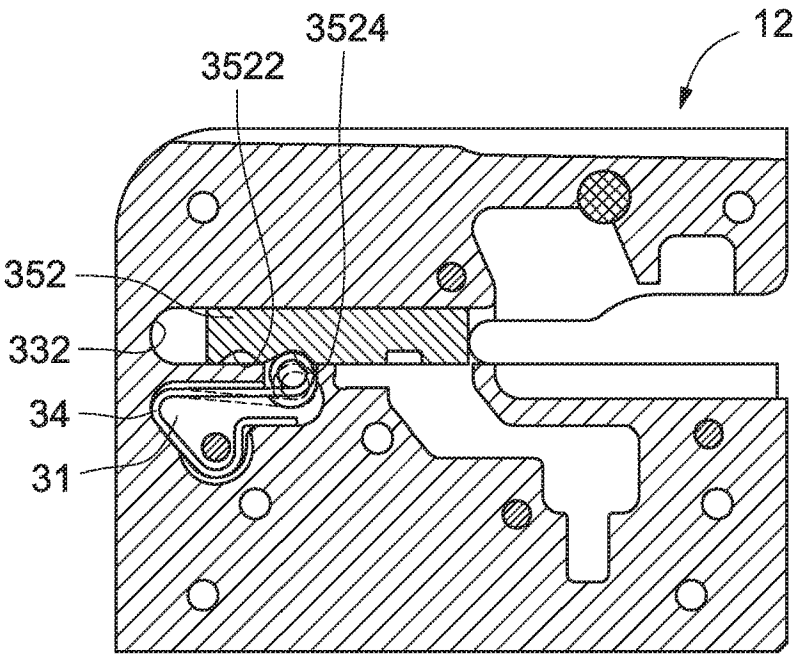
FIG. 12 is a cross-sectional view of the crossbow in another position than shown in FIG. 11.
Figure 11:
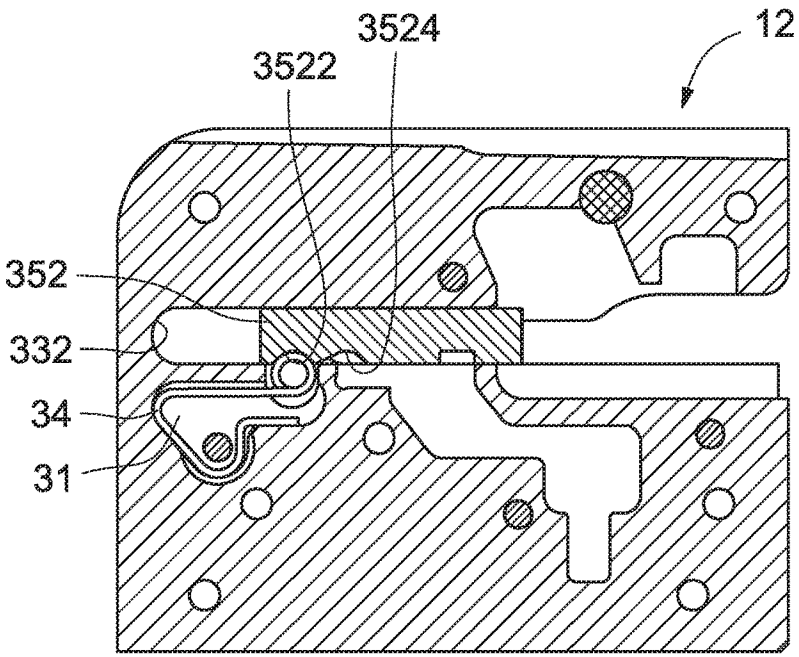
FIG. 11 is a cross-sectional view of the crossbow in another position than shown in FIG. 10.

Referring to FIGS. 5, 6 and 9, the spring 42 is inserted in the cavity 1254.

Referring to FIGS. 5, 6 and 9, a front portion of the stopper 44 is pivotally connected to the rod 174. A middle portion of the stopper 44 is abutted against the spring 42 so that the stopper 44 is biased by the spring 42. A rear portion of the stopper 44 abuts against the portion 244 of the lever 24, thereby hindering movement of the lever 24.

Referring to FIGS. 9 through 13, loading and locking of the string 92 are synchronously executed. The string loader is operated to pull the string 92 into the box 10 via the slots 123 and 143 and press the string 92 against the crank 274 of the string hook 27 so that the string hook 27 is pivoted about the rod 1273. Thus, the claws 272 are lowered, the rear portion of the bar 271 is lifted, and the crank 274 is moved backward.

The crank 274 abuts against the intermediate portion of the safety element 35 and hence moves the safety element 35 to the locking position (FIG. 10) from the unlocking position (FIG. 9). As the safety element 35 is in the locking position, the locking portion 351 of the safety element 35 is located above the abutting portion 246 of the lever 24, and the positioning recess 3524 receives the loop of the elastic latch 34.

The rear portion of the bar 271 of the string hook 27 is away from the branch 261 of the restraining element 26, and the spring 223 is compressed by the rear portion of the bar 271 of the string hook 27. The spring 222 is allowed to push the branch 262 of the restraining element 26 to pivot the restraining element 26 about the rod 1272. Hence, the branch 262 of the restraining element 26 is located below a lower face of the bar 271. The branch 263 of the restraining element 26 abuts against the upper portion of the T-shaped body 242 of the lever 24 and the contact face 1262.

Then, the string loader is released. The spring 223 pivots the string hook 27 by the rear portion of the bar 271. Soon, the pivoting of the string hook 27 is stopped when the rear portion of the bar 271 is brought into contact with the branch 261. Hence, the claws 272 are kept in a lower position to hook the string 92. That is, the loading and locking of the string 92 are completed synchronously.

Moreover, the trigger 21 is locked. The trigger 21 cannot be pivoted since the trigger 21 is connected to the lower portion of the T-shaped body 242 of the lever 24 and the second abutting portion 246 of the lever 24 is stopped by the locking portion 351 of the safety element 35.

The trigger 21 will be locked even if the safety element 35 is moved to the unlocking position from the locking position. This is because the spring 42 will raise the stopper 44 of the string safety unit, and the rear portion of the stopper 44 will stop the abutting portion 244 of the lever 24. The lever 24 cannot be pivoted. Hence, the trigger 21 cannot be pivoted.

Figure 13:
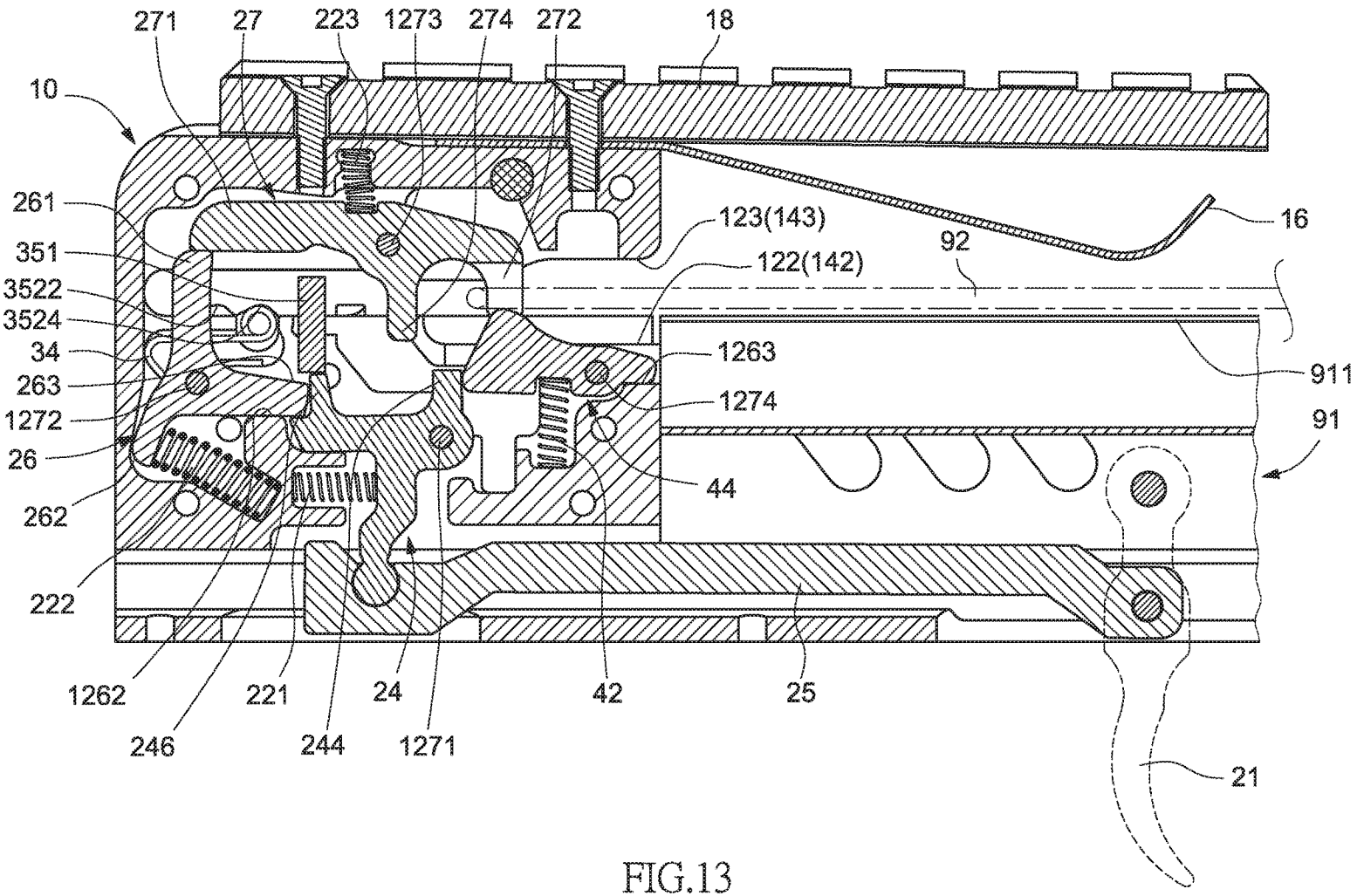
FIG. 13 is a cross-sectional view of the crossbow in another position than shown in FIG. 12.
Figure 14:
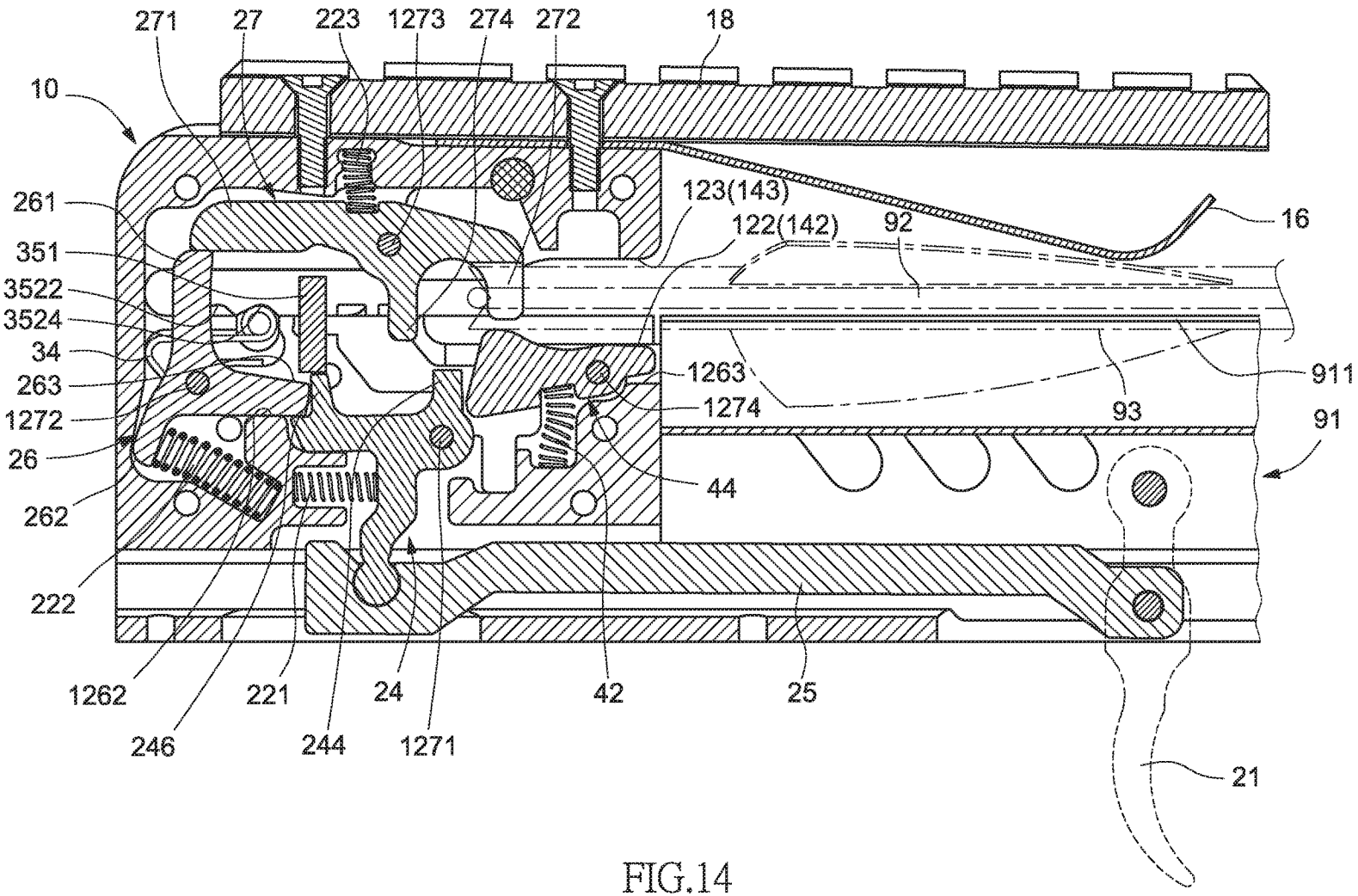
FIG. 14 is a cross-sectional view of the crossbow in another position than shown in FIG. 13.

Referring to FIGS. 13 and 14, loading of the arrow 93 and disabling of the string safety unit are executed synchronously. The arrow 93 is inserted in and moved along the groove 911 of the stock 91, and the nock of the arrow 93 is inserted into the box 10 via the passageway, which includes the grooves 122 and 142. During the insertion of the nock of the arrow 93 into the box 10, the rear portion of the stopper 44 of the string safety unit is pivoted downward about the rod 1274, and the spring 42 is compressed. The rear portion of the stopper 44 of the string safety unit is disengaged from the rear portion the abutting portion 244 of the lever 24. However, the lever 24 and the trigger 21 cannot be pivoted since the trigger safety unit is still actuated.

Figure 15:
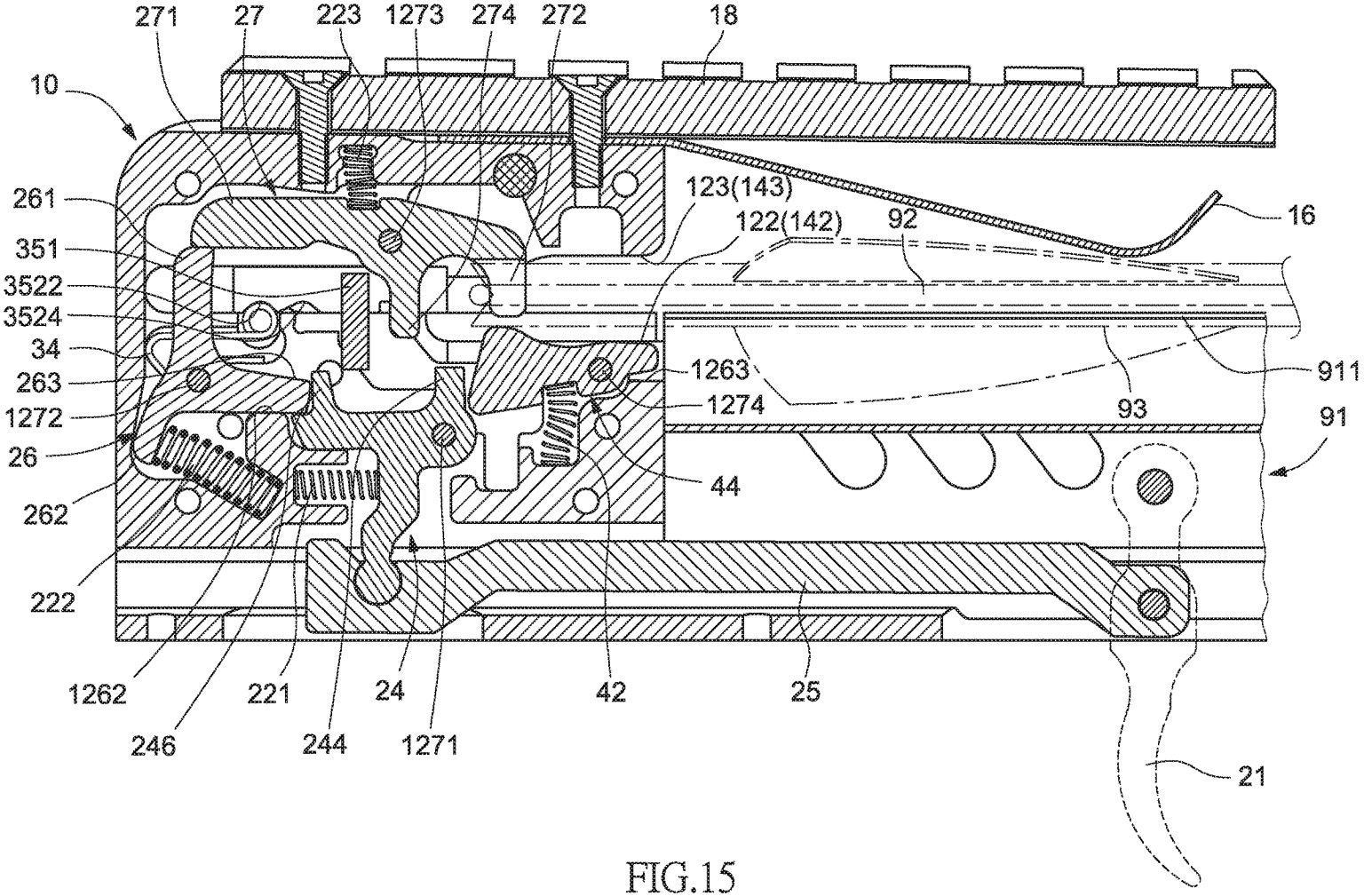
FIG. 15 is a cross-sectional view of the crossbow in another position than shown in FIG. 14.
Figure 16:
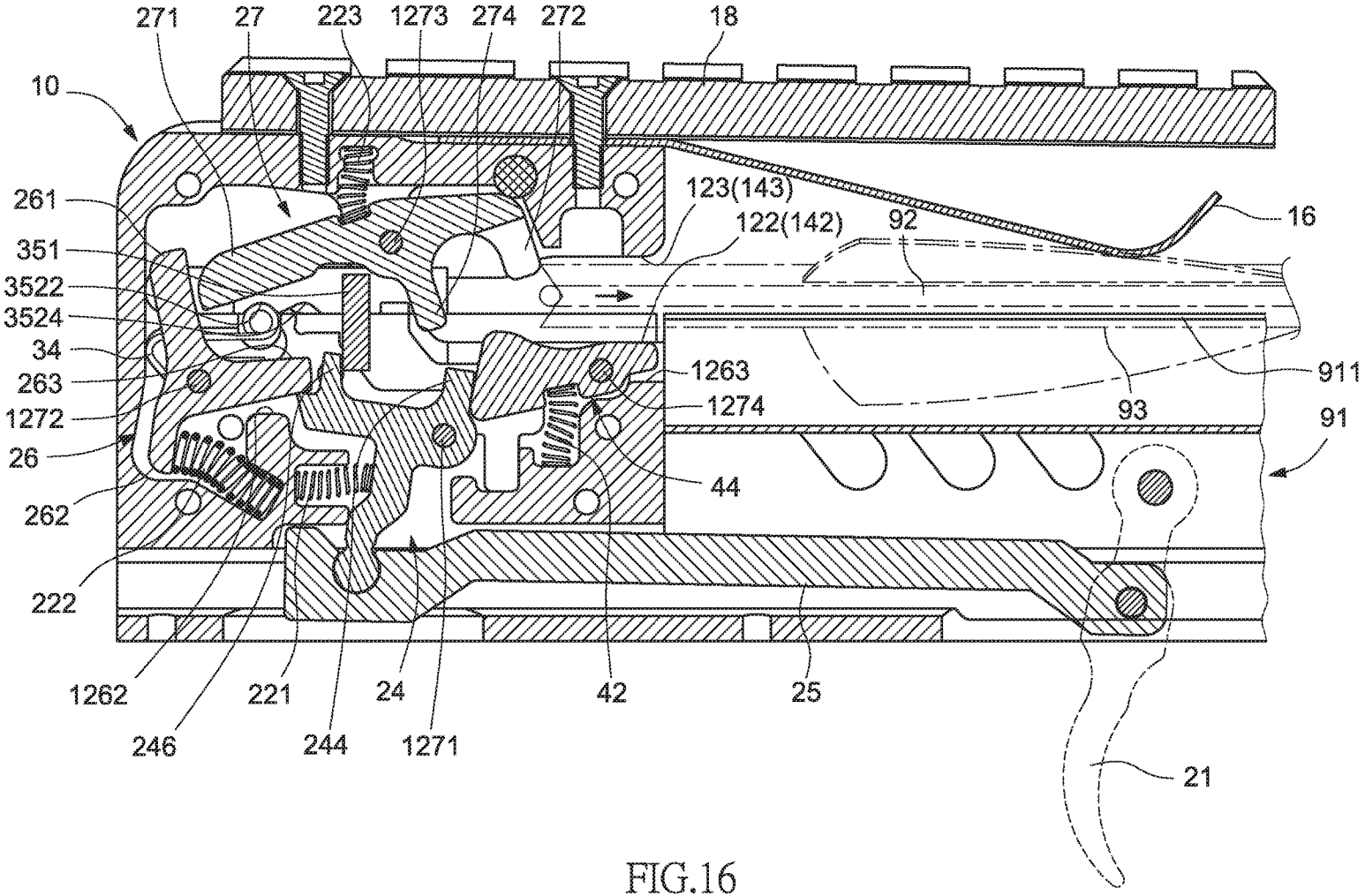
FIG. 16 is a cross-sectional view of the crossbow in another position than shown in FIG. 15.

Referring to FIGS. 14 through 16, the trigger safety unit is disabled to allow projection of the arrow 93. The handles 354 and 355, which extend out of the box 10, are operated to move the safety element 35 to the unlocking position from the locking position. Referring to FIGS. 15 and 16, the positioning recess 3522 of the sliding portion 352 receives the loop of the elastic latch 34.

Now, the locking portion 351 of the safety element 35 is located between the abutting portions 244 and 246 of the lever 24. Thus, a user can pivot the trigger 21 to pivot the lever 24 about the rod 1271 through the connector 25. The lever 24 pivots the restraining element 26 about the rod 1272 by the branch 263. The second branch 263 no longer abuts against the bar 271 of the string hook 27, thereby allowing the spring 223 to lower the rear portion of the string hook 27 and lift the front portion of the string hook 27. Thus, the claws 272 of the string hook 27 are disengaged from the string 92, thereby allowing the string 92 to project the arrow 93 from the stock 91 via the groove 911.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A trigger and safety apparatus for a crossbow that comprises a stock and a string for projecting an arrow that includes a nock, wherein the trigger and safety apparatus comprises:

a box inserted in the stock, and comprising an aperture, a passageway and two slots;

a string hook comprising a rear portion, a front portion, a middle portion connected to an internal portion of the box so that the string hook is movable between a hooking position where the front portion of the string hook hooks the string and a releasing position where the front portion of the string hook releases the string wherein the string hook is moved to the locking position when the string is loaded;

a first spring for biasing the string hook to the releasing position;

a trigger connected to the stock;

a lever comprising an upper portion inserted in the box and a lower portion extending from the box via the aperture;

a second spring for biasing the lever;

a connector for connecting the trigger to the lever;

a restraining element inserted in and connected to the box by a pivot, and comprising:

a first branch including an upper end in contact with the rear portion of the string hook as the string hook is in the hooking position, wherein the rear portion of the string hook exerts a force on the upper end of the first branch of the restraining element toward the pin;

a second branch; and a third branch in contact with the upper portion of the lever;

a third spring for biasing the second branch of the restraining element so that the upper end of the restraining element abuts against the rear portion of the string hook to keep the string hook in the hooking position and that the restraining element prevents the lever from pivoting;

a safety element comprising two sliding portions movably inserted in the box so that the safety element is movable between a locking position and an unlocking position, an intermediate portion interconnecting the two sliding portions, a locking portion extending from the intermediate portion, and two handles extending out of the box from the two sliding portions through the slots; and a stopper inserted in the box, and comprising an upper portion and a rear portion; and a fourth spring biasing the stopper so that the upper portion of the stopper is inserted in the passageway and that the rear portion of the stopper abuts against the lever;

wherein the locking portion abuts against the upper portion of the lever to hinder movement of the lever when the safety element is in the locking position, wherein the locking portion allows the lever to move when the safety element is the unlocking position, and wherein the third spring abuts against the second branch of the restraining element so that the third branch of the restraining element tends to push the upper portion of the lever from the locking portion of the safety element.

2. The trigger and safety apparatus according to claim 1, wherein the box further comprises four cavities for containing the springs.

3. The trigger and safety apparatus according to claim 1, wherein the lever comprises:

a T-shaped body comprising an upper portion extending substantially horizontally and a lower portion extending substantially vertically, wherein the upper portion of the T-shaped body comprises a front section pivotally connected to an internal portion of the box and a rear section normally in contact with another internal portion of the box; and first and second abutting portions extending from an upper face of the T-shaped body, wherein the locking portion abuts against the second abutting portion when the safety element is in the locking position, wherein the stopper normally abuts against the first abutting portion of the lever.

4. The trigger and safety apparatus according to claim 1, wherein the string hook further comprises:

a bar pivotally connected to the box;

two claws extending from the bar and operated to hook the string;

a gap between the claws, wherein the nock is movable in the gap; and a crank extending from the bar, wherein the crank is pushed by the string when the string is loaded.

5. The trigger and safety apparatus according to claim 1, further comprising an arrow-pressing element supported on the box.

6. The trigger and safety apparatus according to claim 1, further comprising a Picatinny rail supported on the box.

7. The trigger and safety apparatus according to claim 1, wherein the box comprises a shell and a cover connected to the shell.

8. The trigger and safety apparatus according to claim 1, wherein the box further comprises two grooves in an internal portion, wherein the two sliding portions are movably inserted in the grooves of the box.

9. The trigger and safety apparatus according to claim 1, further comprising an elastic latch for keeping the safety element in a selected one of the locking and unlocking position.

10. The trigger and safety apparatus according to claim 9, wherein one of the two sliding portions comprises first and second positioning recesses, wherein the elastic latch comprises an operative portion inserted in the first positioning recess when the safety element is in the unlocking position and inserted in the second positioning recess when the safety element is in the locking position.

11. The trigger and safety apparatus according to claim 10, wherein the operative portion of the elastic latch comprises a loop.

12. The trigger and safety apparatus according to claim 9, wherein the box further comprises a trouble-shooting aperture for allowing access to the elastic latch.

* * * * *